US007135631B2

(12) United States Patent
Cherny et al.

(10) Patent No.: US 7,135,631 B2
(45) Date of Patent: Nov. 14, 2006

(54) QUARTZ DRUM AND METHOD OF MAKING

(76) Inventors: Michale N. Cherny, 3944 SE. 17th La., Ocala, FL (US) 34471; Richard R. Weir, 6 Sand Dune Dr., New Smyrna, FL (US) 32169

( * ) Notice: Subject to any disclaimer, the term of this patent is extended or adjusted under 35 U.S.C. 154(b) by 487 days.

(21) Appl. No.: 10/755,705

(22) Filed: Jan. 12, 2004

(65) Prior Publication Data

US 2005/0150352 A1 Jul. 14, 2005

(51) Int. Cl.
*G10D 13/02* (2006.01)

(52) U.S. Cl. ..... 84/411 R

(58) Field of Classification Search ..... 84/411 R, 84/414; 445/26; 313/634
See application file for complete search history.

(56) References Cited

U.S. PATENT DOCUMENTS 3,857,146 A * 12/1974 Engdahl ..... 29/25.35
4,217,807 A 8/1980 Nutting et al.
4,589,322 A * 5/1986 Finkenbeiner ..... 84/402
6,039,894 A 3/2000 Sanjurjo et al.
6,416,836 B1 7/2002 Falster et al.
6,482,753 B1 11/2002 Tometsuka

OTHER PUBLICATIONS

Orlich Percussion, Product Information [online], Retrieved from Orlich Percussion Systems website on Aug. 20, 2003. <http://www.orlichpercussion.com>.
Dichroic Glass FAQ, Product Information [online], Retrieved from Coatings by Sandberg, Inc. website on Aug. 20, 2003. <http://www.cbs-dichroic.com/FAQ.asp>.
Quartz Scientific, Product Information [online], Retrieved from Quartz Scientific, Inc. website on Aug. 20, 2003. <http://www.qsi.thomasregister.com/olc53445003/home.htm>.

* cited by examiner

*Primary Examiner*—Kimberly Lockett
(74) *Attorney, Agent, or Firm*—Allen, Dyer, Doppelt, Milbrath & Gilchrist, P.A.

(57) ABSTRACT

A method of making a quartz-shell drum includes the steps of heating a quartz tube to a temperature at least sufficient to enable quartz to flow. A diameter of a portion of the heated quartz tube is enlarged to a predetermined size. The enlarged tube is cut perpendicular to a longitudinal axis to create a shell having a desired height. A top edge and a bottom edge of the shell are ground to form smooth radii. The top and the bottom edges are fused to create top and bottom rounded edges. In an alternate embodiment, the top edge is instead formed to be inwardly angled. Finally, a top and a bottom head are affixed to the top and the bottom edges, respectively, to form a drum.

18 Claims, 2 Drawing Sheets

QUARTZ DRUM AND METHOD OF MAKING

FIELD OF INVENTION

The present invention generally relates to musical instruments, and, in particular, to musical drums and methods of making musical drums.

BACKGROUND

Musical instruments comprising quartz and glass elements are known in the art, for example the instrument known as a "glass harmonica," which typically includes a plurality of glass or quartz cups of various sizes. Sound is produced by running a moistened finger around the rim of a cup, the frequency determined by the size and composition of the cup.

Musical drums are typically made of fiberglass or acrylic plastic. Glass-shell drums are also known that comprise multiple plates of glass mounted upon a brass superstructure.

SUMMARY OF THE INVENTION

The present invention is directed to a method of making a quartz-shell drum. The method comprises the steps of heating a quartz tube to a temperature at least sufficient to enable quartz to flow. A diameter of a portion of the heated quartz tube is enlarged to a predetermined size. The enlarged tube is cut perpendicular to a longitudinal axis to create a shell having a desired height. A top bearing edge and a bottom bearing edge of the shell are ground to form smooth radii. (Hereinafter, the terms "top edge" and "bottom edge" are to be construed as "top bearing edge" and "bottom bearing edge," as they are known in the art.) The top and the bottom edges are fused to create top and bottom rounded edges. In an alternate embodiment, the top edge is instead formed to be inwardly angled. Finally, a top and a bottom head are affixed to the top and the bottom edges, respectively, to form a drum.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENT

A description of the preferred embodiments of the present invention will now be presented with reference to FIGS. 1–5.

Figure 1:
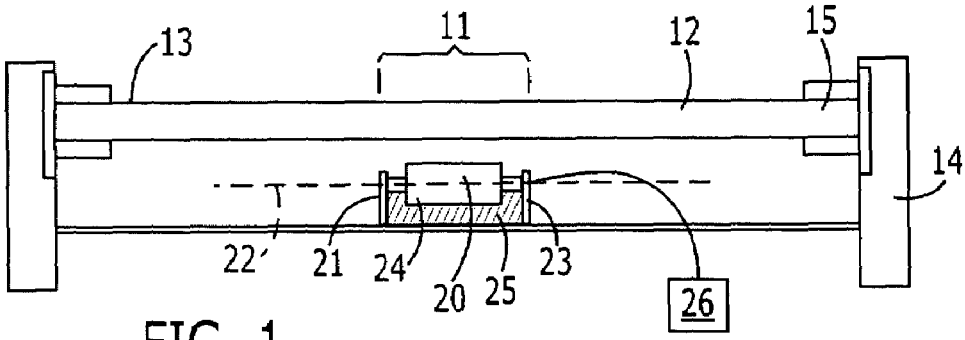
FIG. 1 is a side perspective view of a quartz tube mounted on a lathe.

The method of the present invention for making a quartz-shell drum 10 comprises the steps of heating a central portion 11 of a quartz tube 12 to a temperature at least sufficient to enable quartz to flow. The quartz tube 12 preferably comprises a generally cylindrical stock made from 99.9% pure crushed crystalline quartz powder. The heating step is preferably accomplished by affixing a headstock end 13 of the quartz tube 12 for rotation to a glass lathe 14, leaving a tailstock end 15 opposed to the headstock end 13 decoupled from the lathe's rotational motion (FIG. 1). The heated quartz tube 12 is rotated using the lathe 14, and a high-temperature hydrogen/oxygen torch 33 is used to heat the quartz tube's central portion 11 to approximately 2300° C.

The lathe 14 is used to apply centripetal acceleration, in order to permit a wall 16 of the quartz tube 12 to spread outward, thereby enlarging the quartz tube's diameter 17 along the central portion 11. Since the torch is only applied to the central portion 11, a diameter 18 at the headstock 13 and the tailstock 15 ends remains smaller than that of the central portion 11. Molten quartz material moves toward the central portion 11 from the tailstock end 15, maintaining a substantially equal wall thickness, a process that continues until a predetermined diameter is reached.

Figure 2:
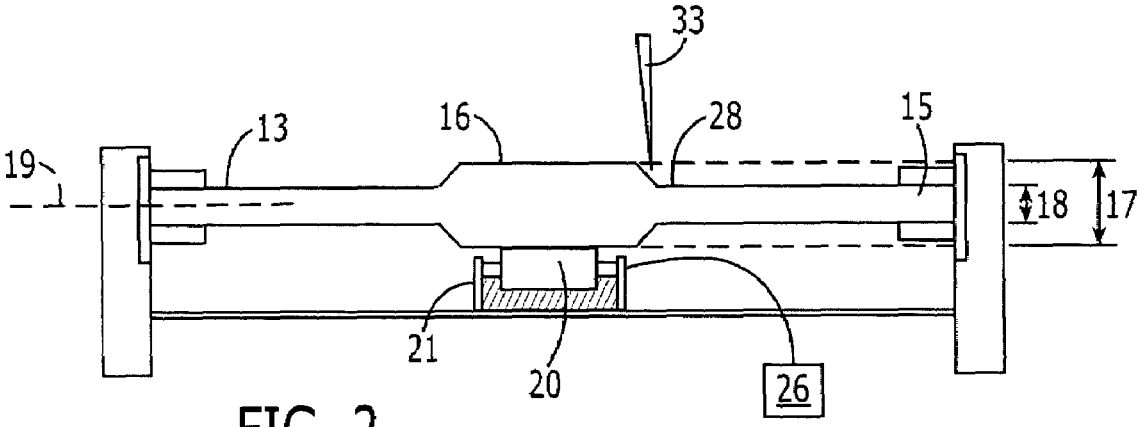
FIG. 2 is a side perspective view of the quartz tube having an enlarged central portion.

In order to ensure that the predetermined size is accomplished, a diameter-controlling means is affixed at a predetermined distance from the quartz tube's longitudinal axis 19 (FIG. 2). The predetermined distance is selected to limit an enlargement of the quartz tube's central portion diameter 17 to the predetermined size.

In a preferred embodiment, the diameter-controlling means comprises a graphite roller 20 that is affixed for rotation to a support 21 and means for rotating the roller. The roller 20 is positioned so that its longitudinal axis 22 is substantially perpendicular to the quartz tube's longitudinal axis 19, the roller 20 thereby positioned to control the central portion's diameter 17.

The roller support 21 includes a cooling bath 23 that is positioned to encompass a lower portion 24 of the roller 20, leaving approximately 0.5 in. of the roller 20 protruding above the bath 23. The bath 23 is adapted to hold a cooling fluid 25, such as water, flowing through the bath. The roller 20 is rotatable using a motor 26 affixed to the support 21, and thus portions of the roller 20 are positioned to rotate through the bath 23, thereby cooling the section of the quartz tube's central portion 11 adjacent the roller 20.

The wall thickness 27 is observed and controlled by the length of time the process is permitted to continue, so that when the quartz tube's central portion 11 reaches a predetermined diameter 17 and wall thickness 27, the lathe's rotation is stopped.

In a particular embodiment, this process is repeated iteratively, for example, three times, to achieve a desired diameter. Each subsequent time the roller 20 is lowered to enable an increase in diameter. Preferably also substantially the entire process is automated, with the motor 26, torch 33, and roller 20 on a track moving in concert.

The tube 12 is then reheated to remove any residual strain or stress in the material.

Figure 3:
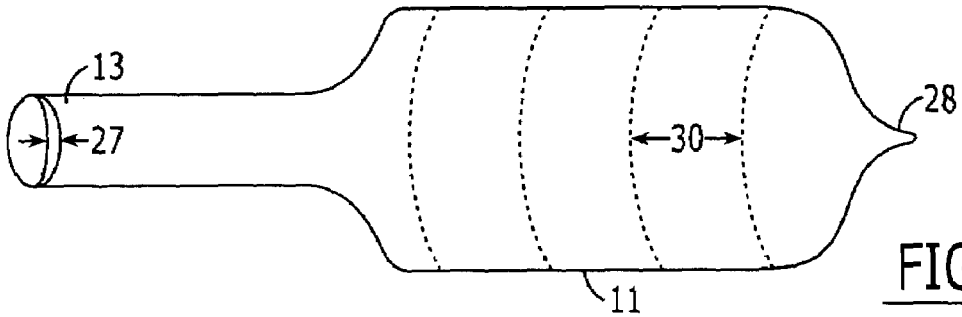
FIG. 3 is a side perspective view of the tube ready for cutting.

With the tube 12 still remaining on the lathe 14, the quartz tube's central portion 11 is separated from the headstock end 15 by using the torch to heat a location 28 adjacent an end of the central portion 11 adjacent the headstock end 15 sufficiently to enable the central portion 11 to be pulled away, with the tailstock end 13 remaining affixed to the central portion 11 (FIG. 3).

Next the enlarged central portion 11 of the tube 12 is cut perpendicular to the tube's longitudinal axis 19 to create a shell 29 having a desired height 30, each shell 29 having a top edge 31 and a bottom edge 32. The cutting step comprises affixing the central portion 11 for rotation to a cutting machine having a diamond wheel thereon to dice the tube into rings. The rings 29 are trimmed carefully to ensure that no chipped or square cuts remain on the edges 31,32.

Figure 4A:
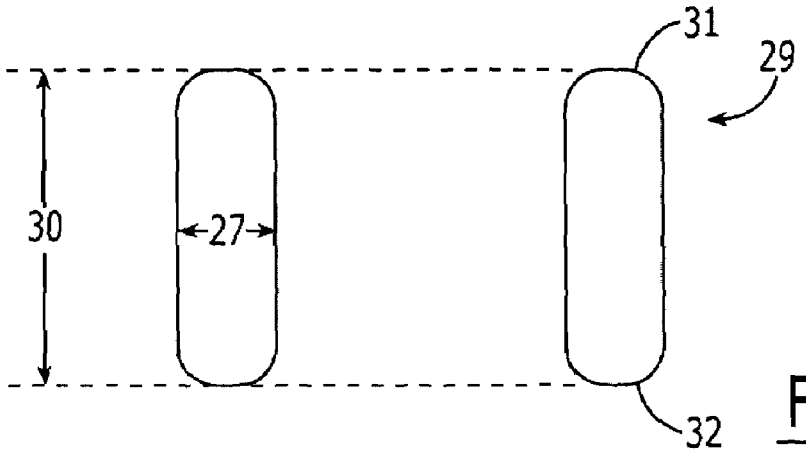
FIGS. 4A and 4B are side cross-sectional views of the shell with a rounded top edge and an inwardly angled top edge, respectively.
Figure 4B:
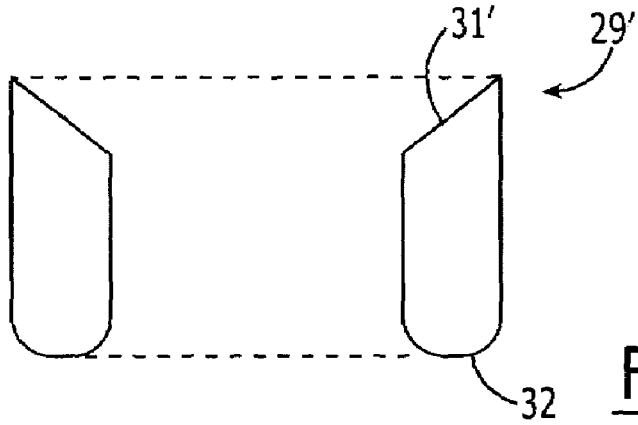
Figure 5:
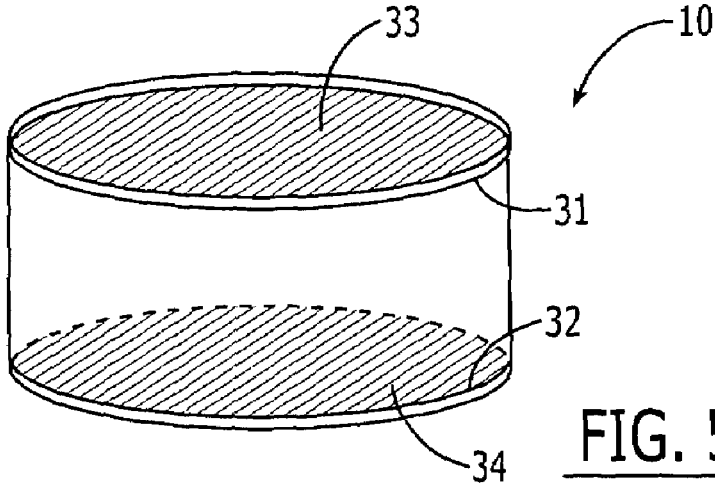
FIG. 5 is a side perspective view of a finished quartz shell drum.

Next the top 31 and bottom 32 edges of the shell 29 are ground to form smooth radii (FIG. 4A). In an alternate embodiment (FIG. 4B), the top edge 31' has an inward angle, which is believed preferable. The grinding is accomplished with a belt grinder and then hand grinding. The shell 29 is then cleaned for approximately 30 min. in a cleaning solvent such as ammonium bifluoride to ensure purity. Next, the shell 29 is washed and dried.

Finally, the top 31 and the bottom 32 edges are fused to create top and bottom rounded edges. In the alternate embodiment the shell 29' of FIG. 4B, the top edge 31' is fused in the inwardly angled state. The fusing step in a preferred embodiment comprises heating the top 31 and the bottom 32 edges with a torch ("firepolishing") to seal and fuse the quartz. The shell 29 is then cleaned and annealed in an annealing oven.

To create a drum 10 (FIG. 5), a top 33 and a bottom 34 head are affixed to the top 31 and the bottom 32 edges, respectively, by methods known in the art.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the method illustrated and described herein are by way of example, and the scope of the invention is not limited to the exact details.

Having now described the invention, and the advantageous new and useful results obtained thereby, the new and useful methods, constructions, and reasonable equivalents thereof obvious to those skilled in the art, are set forth in the appended claims.

What is claimed is:

1. A method of making a quartz-shell drum comprising the steps of:

heating a quartz tube to a temperature at least sufficient to enable quartz to flow;

enlarging a diameter of a portion of the heated quartz tube to a predetermined size;

cutting the enlarged tube perpendicular to a longitudinal axis to create a shell having a desired height;

grinding a top edge and a bottom edge of the shell to form smooth radii;

fusing the top and the bottom edges to create top and bottom rounded edges; and affixing a top and a bottom head to the top and the bottom edges, respectively.

2. The method recited in claim 1, wherein the quartz tube heating step comprises heating the quartz tube using a high-temperature hydrogen/oxygen torch.

3. The method recited in claim 2, wherein the torch is used to heat the quartz tube to approximately 2300° C.

4. The method recited in claim 2, wherein the heating step comprises heating a central portion of the quartz tube, and the diameter-enlarging step comprises:

prior to the heating step, affixing a headstock end of the quartz tube for rotation to a glass lathe, leaving a tailstock end opposed to the headstock end decoupled from lathe rotational motion;

during the heating step, rotating the heated quartz tube using the lathe, applying centripetal acceleration for permitting a wall of the quartz tube to spread outward, thereby enlarging the quartz tube diameter along the central portion, leaving a diameter at the headstock and the tailstock ends smaller than the central portion diameter; and when the quartz tube diameter reaches a predetermined size, stopping the lathe rotation.

5. The method recited in claim 4, wherein the diameter-enlarging step further comprises, prior to the rotating step, affixing a diameter-controlling means at a predetermined distance from the quartz tube longitudinal axis, the predetermined distance selected to limit an enlargement of the quartz tube central portion diameter to the predetermined size.

6. The method recited in claim 5, wherein the diameter-controlling means comprises a graphite roller affixed for rotation to a support, a longitudinal axis of the roller substantially perpendicular to the quartz tube longitudinal axis, the roller positioned to control the central portion diameter.

7. The method recited in claim 6, wherein the diameter-controlling means further comprises means for rotating the roller and a cooling bath positioned to encompass a lower portion of the roller, the bath adapted to hold a cooling fluid through which the roller is rotatable by the rotating means.

8. The method recited in claim 4, further comprising the step, prior to the cutting step, of separating the quartz tube central portion from the headstock end.

9. The method recited in claim 8, wherein the separating step comprises using the torch to heat a location adjacent an end of the central portion adjacent the headstock end sufficiently to enable the central portion to be pulled apart therefrom.

10. The method recited in claim 1, further comprising the step, following the enlarging step, of reheating the tube.

11. The method recited in claim 1, wherein the cutting step comprises affixing the central portion for rotation to a cutting machine having a diamond wheel thereon.

12. The method recited in claim 1, wherein the grinding step comprises using a belt grinder and then hand grinding.

13. The method recited in claim 1, further comprising the steps of cleaning the shell in ammonium bifluoride following the grinding step, and washing and drying the shell.

14. The method recited in claim 1, wherein the fusing step comprises heating the top and the bottom edges with a torch to seal and fuse the quartz.

15. The method recited in claim 1, further comprising the step, following the fusing step, the steps of cleaning the shell and annealing the cleaned shell in an annealing oven.

16. A quartz-shell drum made by the method of claim 1.

17. A method of making a quartz-shell drum comprising the steps of:

heating a quartz tube;

enlarging a diameter of a portion of the heated quartz tube to a predetermined size;

cutting the enlarged tube perpendicular to a longitudinal axis to create a shell having a desired height;

grinding a top edge and a bottom edge of the shell to form a smooth radius on the bottom edge and an inwardly angled top edge;

fusing the top and the bottom edges to create top and bottom rounded edges; and affixing a top and a bottom head to the top and the bottom edges, respectively.

18. A quartz-shell drum made by the method of claim 17.

* * * * *